US010464308B2

(12) United States Patent
Liu et al.

(10) Patent No.: US 10,464,308 B2
(45) Date of Patent: Nov. 5, 2019

(54) WHEEL CONVEYANCE DEVICE OR STATIONS, WHEEL POSITIONING AND CLAMPING SYSTEM FOR A PRINTING DEVICE

(71) Applicant: CITIC Dicastal CO.,LTD, Qinhuangdao (CN)

(72) Inventors: Huiying Liu, Qinhuangdao (CN); Dan Yao, Qinhuangdao (CN); Lei Liu, Qinhuangdao (CN)

(73) Assignee: CITIC DICASTAL CO., LTD, Qinhuangdao, Hebei (CN)

( * ) Notice: Subject to any disclaimer, the term of this patent is extended or adjusted under 35 U.S.C. 154(b) by 176 days.

(21) Appl. No.: 15/803,167

(22) Filed: Nov. 3, 2017

(65) Prior Publication Data

US 2019/0022997 A1 Jan. 24, 2019

(30) Foreign Application Priority Data

Jul. 21, 2017 (CN) ..... 2017 1 05983262

(51) Int. Cl.
*B41F 17/08* (2006.01)

(52) U.S. Cl.
CPC ..... *B41F 17/08* (2013.01)

(58) Field of Classification Search
CPC ..... B41F 17/08
USPC ..... 101/407.1
See application file for complete search history.

(56) References Cited

U.S. PATENT DOCUMENTS

| | | | | |
|---|---|---|---|---|
| 3,868,902 | A * | 3/1975 | Bradshaw | B28B 11/001 101/44 |
| 6,568,320 | B2 * | 5/2003 | Wada | B41F 16/008 101/35 |
| 8,677,897 | B2 * | 3/2014 | Vogt | B41F 17/001 101/407.1 |
| 2011/0041716 | A1 * | 2/2011 | Willshere | B41F 15/08 101/407.1 |
| 2012/0234824 | A1 * | 9/2012 | Nakatsu | C21D 1/42 219/600 |
| 2014/0231221 | A1 * | 8/2014 | Miyazaki | B29D 30/0016 198/470.1 |

* cited by examiner

*Primary Examiner* — Anthony H Nguyen
(74) *Attorney, Agent, or Firm* — Calfee, halter & Griswold LLP

(57) ABSTRACT

Disclosed is a double-station printing device for printing a steel grade on rims, comprising a first station driving cylinder, a second station driving cylinder, a second moving platform, sensor supports, visual sensors, support frames, lifting cylinders, guide posts, lifting platforms, steel grade printers and the like. In the working process of the device, a wheel inlet roller bed continuously feeds wheels, and a first station and a second station alternatively receive the wheels, thereby avoiding long-time waiting of the wheels on the wheel inlet roller bed.

3 Claims, 6 Drawing Sheets

WHEEL CONVEYANCE DEVICE OR STATIONS, WHEEL POSITIONING AND CLAMPING SYSTEM FOR A PRINTING DEVICE

CROSS-REFERENCE TO RELATED APPLICATIONS

This application claims priority to Chinese Patent Application No. 2017105983262, filed on Jul. 21, 2017, which is hereby incorporated by reference in its entirety.

TECHNICAL FIELD

The present application relates to the technical field of steel grade printing, specifically to a device for printing a steel grade for a wheel.

BACKGROUND ART

Airtight detection of wheels is an important link in wheel production. In order that wheels have traceability, steel grades are printed on rims below valve holes of the wheels passing the airtight detection, wherein the steel grades represent passing the airtight detection. In actual production, steel grade identifiers are still manually printed in some old production lines, so that the efficiency is low, the depths of the identifiers are not consistent, and the risk of missing printing also exists; and some automatic production lines realize automation, but the efficiency is low, and the period is long.

SUMMARY OF THE INVENTION

The aim of the present application is to provide an efficient double-station airtight grade printing device.

In order to fulfill the above aim, the present application adopts the following technical solution: A double-station printing device for printing a steel grade on rims comprises a frame, slide ways, a first moving platform, guide rails, a left slide plate, a right slide plate, gear racks, clamping cylinders, servo motors, clamping rollers, working roller beds, a wheel inlet roller bed, a first wheel outlet roller bed, a second wheel outlet roller bed, a first station driving cylinder, second station driving cylinder, a second moving platform, sensor supports, visual sensors, support frames, lifting cylinders, guide posts, lifting platforms and steel grade printers.

The working roller bed are mounted on the first moving platform, and the guide rails are symmetrically mounted on the first moving platform, and the left slide plate and the right slide plate are respectively mounted on the guide rails and connected with each other via the gear rack to fulfill the purpose of synchronous motion. Two of the servo motors are mounted on the left slide plate, the output ends of the servo motors control rotation of the clamping rollers via shafts, two of the servo motors are also mounted on the right slide plate, and the output ends of the servo motors control rotation of the clamping rollers via shafts. The clamping cylinder is mounted on the support frame of the working roller bed, the output end of the clamping cylinder is connected with the left slide plate, and when the clamping cylinder drives the left slide plate to move, the right slide plate moves synchronously under the action of the gear rack, so that the four clamping rollers position and clamp the wheel. When the servo motors are started, the clamping rollers rotate, and drive the wheel to rotate under the action of friction, so that the clamped wheel rotates. This is a wheel positioning and clamping system.

The lifting cylinder is mounted on the support frame, the output end of the lifting cylinder is connected with the lifting platform, the four guide posts are mounted at the bottom of the lifting platform, and the steel grade printer is mounted on the lifting platform. Under the guiding effect of the guide posts, the lifting cylinder controls up-and-down motion of the lifting platform to adjust the vertical position of the steel grade printer, thus printing wheels having different rim widths. When the width of the wheel is changed, only the vertical position of the steel grade printer is correspondingly adjusted. The sensor support is mounted on the frame and portal-shaped, the output end of the steel grade printer penetrates through the portal-shaped hollow area, and the visual sensor is located above the wheel and mounted on the sensor support. When the wheel rotates, the visual sensor can recognize the position of a valve hole; and when the valve hole is opposite to a steel grade head, the wheel stops rotating, and the steel grade printer is started to print a steel grade on the rim below the valve hole. This is a wheel steel grade printing system.

The two slide ways are respectively mounted on the left side and right side of the frame, slide rails are arranged at two ends of the first moving platform, and the slide rails are matched with the slide ways. The first station driving cylinder is mounted on the frame, and the output end of the first station driving cylinder is connected with the first moving platform and drives the first moving platform to move along the slide ways. When the output end of the first station driving cylinder is extended, the first moving platform is driven to be butt-jointed with the wheel inlet roller bed; after the wheel enters the working roller bed, the positioning and clamping system clamps the wheel; and when the output end of the first station driving cylinder is retracted and reset, the first moving platform is driven to reset, and the steel grade printing system prints a steel grade on the rim below the valve hole. This is a first station.

The second station is completely the same as the first station, and is also composed of a wheel positioning and clamping system and a steel grade printing system. Slide rails are arranged at two ends of the second moving platform, and the slide rails are matched with the slide ways. The second station driving cylinder is mounted on the frame, the output end of the second station driving cylinder is connected with the second moving platform and drives the second moving platform to move along the slide ways, and the same wheel positioning and clamping system is arranged on the second moving platform as on the first moving platform.

The working process of the device is as follows: in an initial state, the first station driving cylinder and the second station driving cylinder are retracted, and the first moving platform and the second moving platform are not butt-jointed with the wheel inlet roller bed. Firstly, the first station driving cylinder is started to drive the first moving platform to be butt-jointed with the wheel inlet roller bed, and the wheel enters the working roller bed from the wheel inlet roller bed; then, the clamping cylinder is started to position and clamp the wheel; next, the first station driving cylinder is retracted to bring the clamped wheel to the first station. At the moment, the second station driving cylinder is started to drive the second moving platform to be butt-jointed with the wheel inlet roller bed, and the wheel enters the working roller bed from the wheel inlet roller bed; and then the wheel is positioned, clamped and brought to the second station. When platform butt joint and wheel positioning and clamping are performed on the second station and the second moving platform brings the wheel to the second station, operations of wheel rotation, finding of the valve hole, printing of the steel grade, loosening of the wheel and feeding to the first wheel outlet roller bed are completed. After the second moving platform brings the wheel to the second station, the first station driving cylinder is restarted to drive the first moving platform to be butt-jointed with the wheel inlet roller bed again, next wheel is positioned and clamped, and at the same time, operations of wheel rotation, finding of the valve hole, printing of the steel grade, loosening of the wheel and feeding to the first wheel outlet roller bed are completed. Next, the second station driving cylinder is restarted to drive the second moving platform to be butt-jointed with the wheel inlet roller bed again, next wheel is positioned and clamped, and recycling like this In the working process of the device, the wheel inlet roller bed continuously feeds wheels, and the first station and the second station alternatively receive the wheels, thereby avoiding long-time waiting of the wheels on the wheel inlet roller bed. Printing steel grade is completed within the wheel positioning and clamping time, so the production period is determined by the time sum of platform butt joint, wheel positioning and clamping and platform reset, and the wheel positioning and clamping process and the steel grade printing process are completed within the same time via the double stations, so that the period is greatly shortened; and the device has the advantages of short period, high efficiency, novel layout, advanced process and strong generality.

Figure 1:
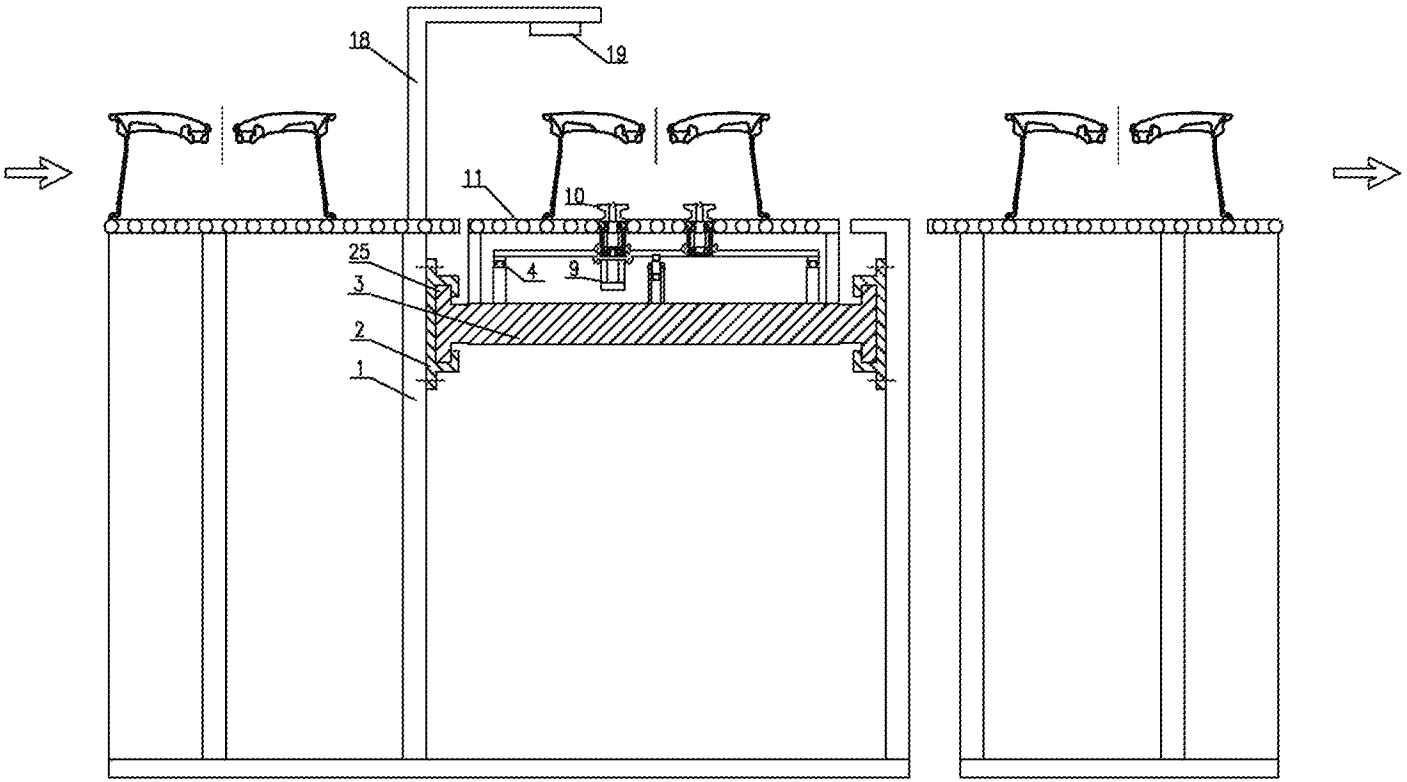
FIG. 1 is a front view of a double-station printing device for printing a steel grade on rims of the present application.
Figure 2:
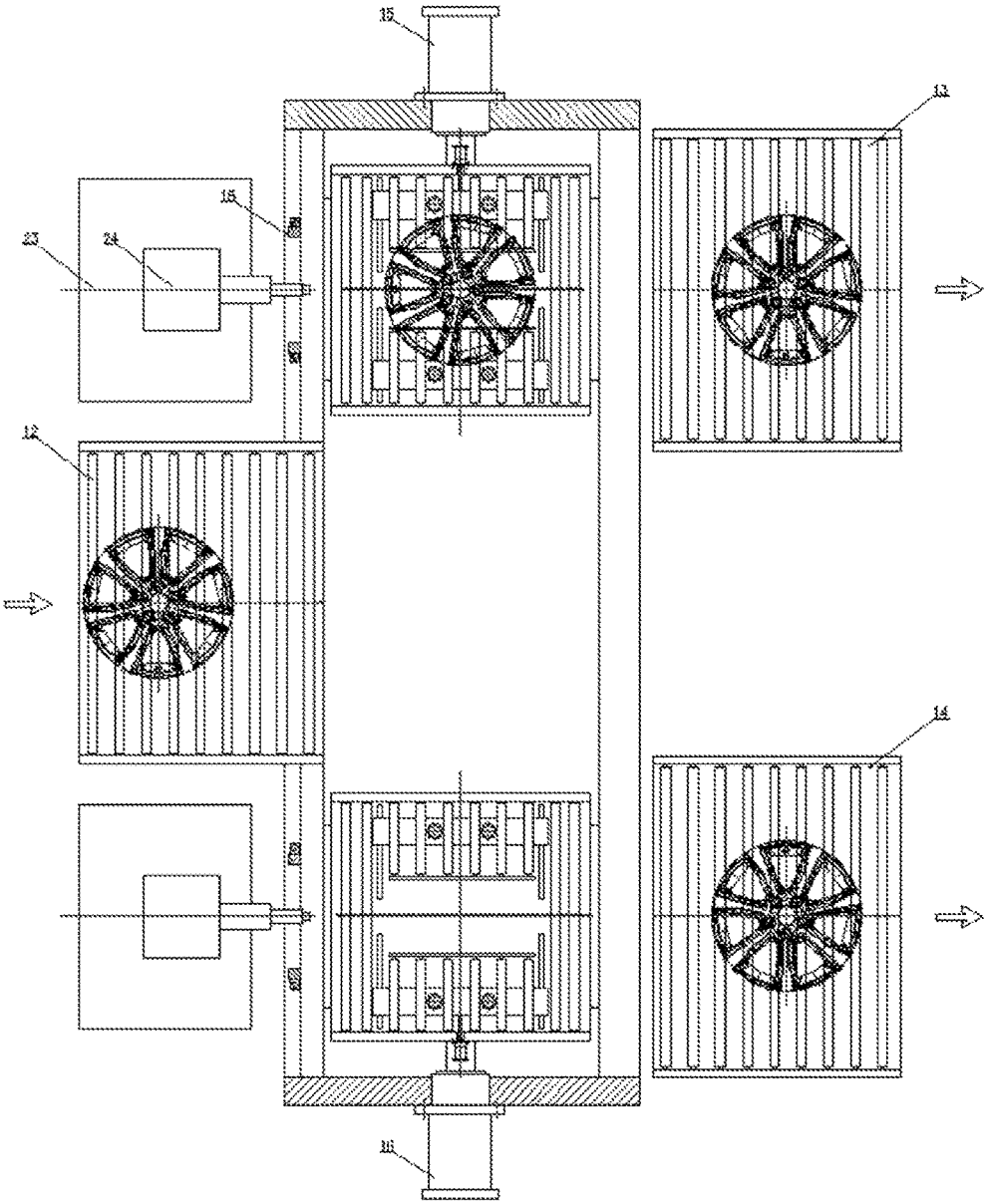
FIG. 2 is a top view of the double-station printing device for printing a steel grade on rims of the present application.
Figure 3:
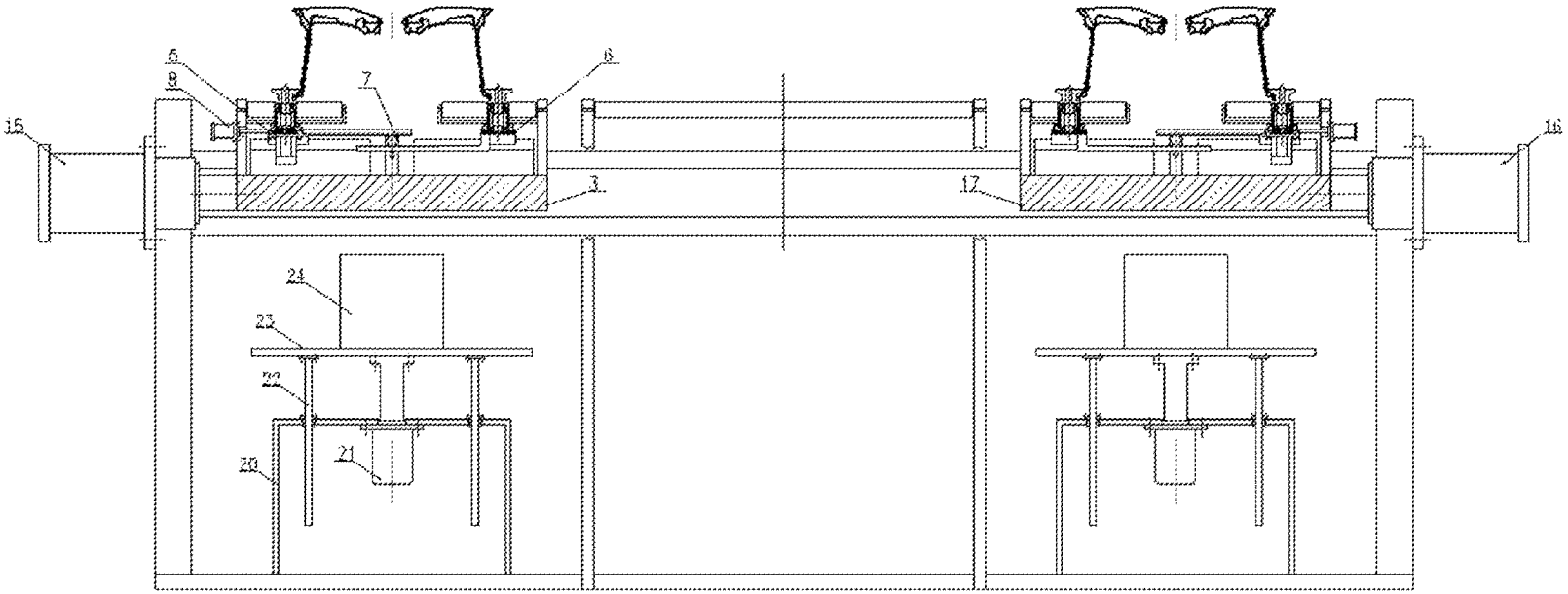
FIG. 3 is a left view of the double-station printing device for printing a steel grade on rims of the present application.
Figure 4:
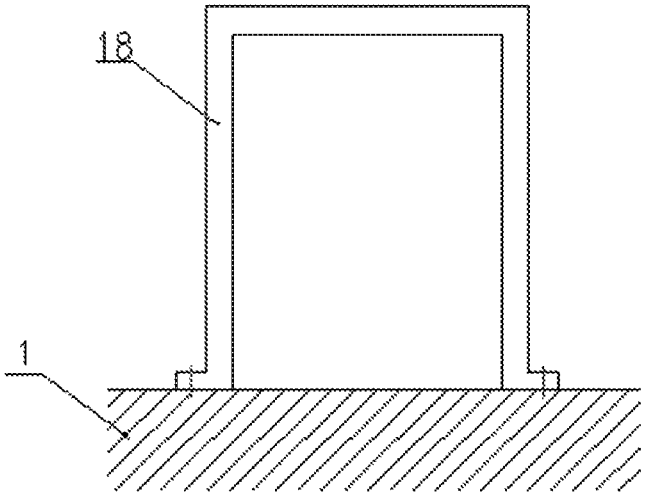
FIG. 4 is a left view of a sensor support of the double-station printing device for printing a steel grade on rims of the present application.
Figure 5:
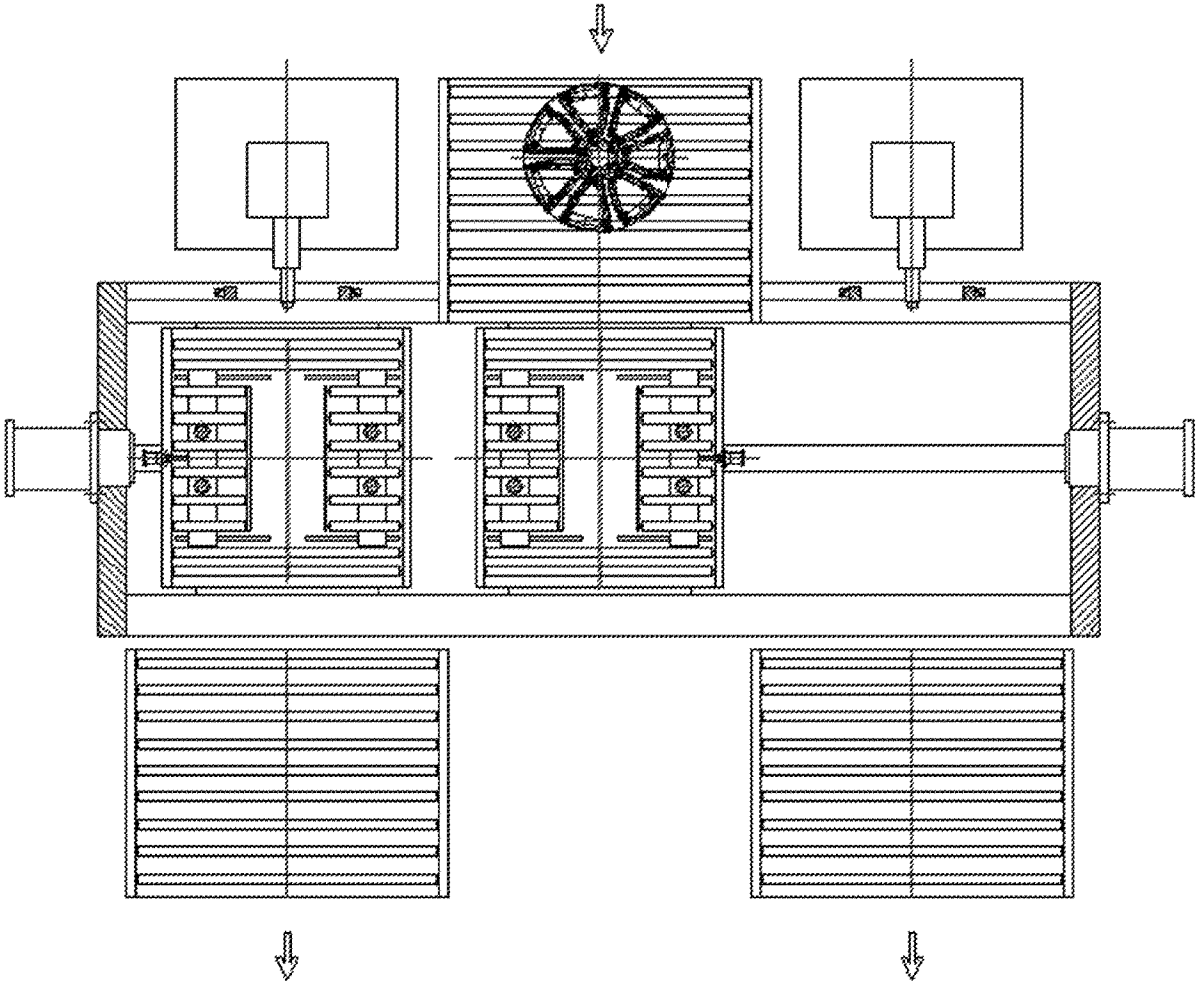
FIG. 5 is a schematic diagram of butt joint at a first station of the double-station printing device for printing a steel grade on rims of the present application.
Figure 6:
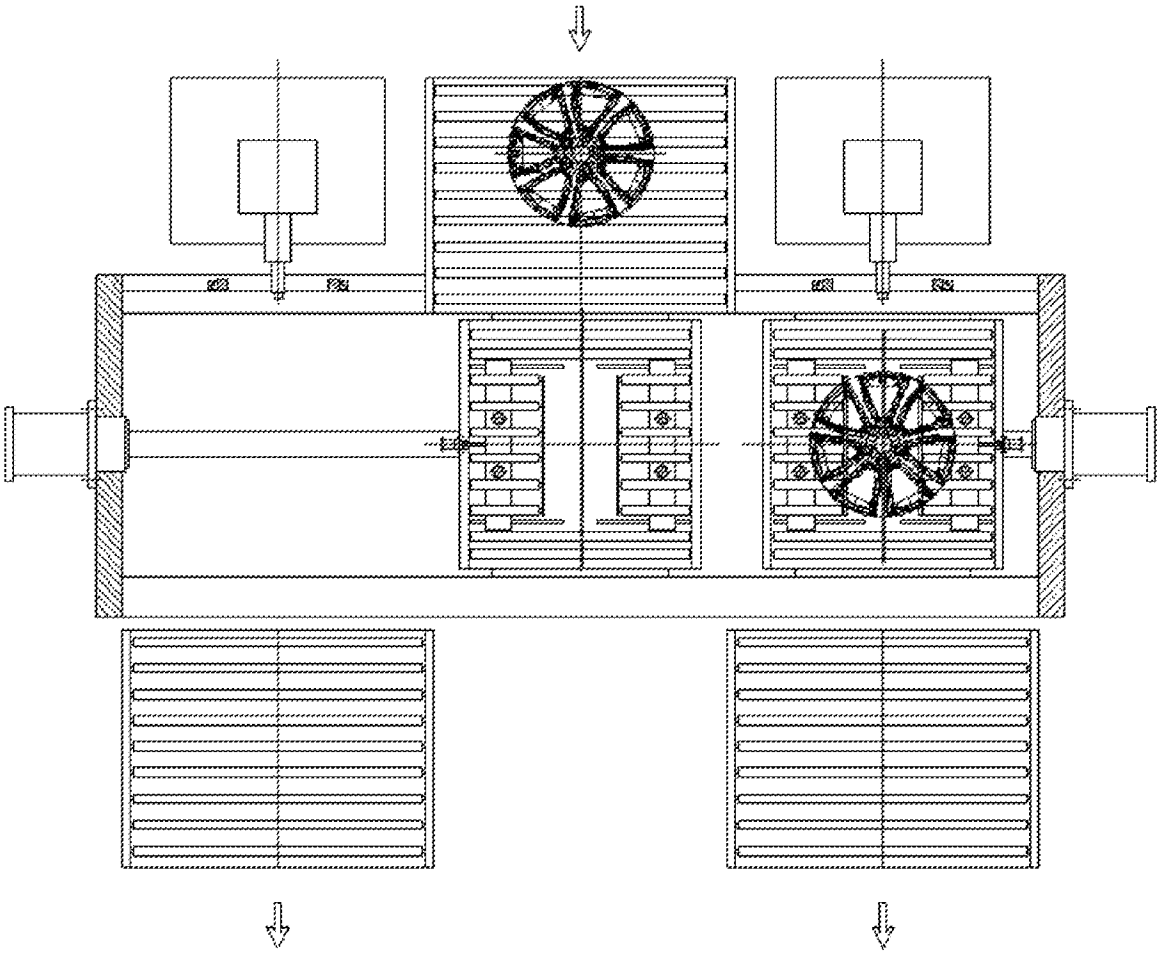
FIG. 6 is a schematic diagram of butt joint at a second station of the double-station printing device for printing a steel grade on rims of the present application.

In figures: 1—frame, 2—slide way, 3—first moving platform, 4—guide rail, 5—left slide plate, 6—right slide plate, 7—gear rack, 8—clamping cylinder, 9—servo motor, 10—clamping roller, 11—working roller bed, 12—wheel inlet roller bed, 13—first wheel outlet roller bed, 14—second wheel outlet roller bed, 15—first station driving cylinder, 16—second station driving cylinder, 17—second moving platform, 18—sensor support, 19—visual sensor, 20—support frame, 21—lifting cylinder, 22—guide post, 23—lifting platform, 24—steel grade printer, 25—slide rail.

DETAILED DESCRIPTION OF THE INVENTION

Details and working conditions of a specific device provided by the present application will be given below in combination with the accompanying drawings.

A double-station printing device for printing a steel grade on rims comprises a frame 1, slide ways 2, a first moving platform 3, guide rails 4, a left slide plate 5, a right slide plate 6, gear racks 7, clamping cylinders 8, servo motors 9, clamping rollers 10, working roller beds 11, a wheel inlet roller bed 12, a first wheel outlet roller bed 13, a second wheel outlet roller bed 14, a first station driving cylinder 15, a second station driving cylinder 16, a second moving platform 17, sensor supports 18, visual sensors 19, support frames 20, lifting cylinders 21, guide posts 22, lifting platforms 23 steel grade printers 24 and slide rails 25.

The working roller bed 11 are mounted on the first moving platform 3, and the guide rails 4 are symmetrically mounted on the first moving platform 3, and the left slide plate 5 and the right slide plate 6 are respectively mounted on the guide rails 4 and connected with each other via the gear rack 7 to fulfill the purpose of synchronous motion. Two of the servo motors 9 are mounted on the left slide plate 5, the output ends of the servo motors 9 control rotation of the clamping rollers 10 via shafts, two of the servo motors 9 are also mounted on the right slide plate 6, and the output ends of the servo motors 9 control rotation of the clamping rollers 10 via shafts. The clamping cylinder 8 is mounted on the support frame of the working roller bed 11, the output end of the clamping cylinder 8 is connected with the left slide plate 5, and when the clamping cylinder 8 drives the left slide plate 5 to move, the right slide plate 6 moves synchronously under the action of the gear rack 7, so that the four clamping rollers 10 position and clamp the wheel. When the servo motors 9 are started, the clamping rollers 10 rotate and drive the wheel to rotate under the action of friction, so that the clamped wheel rotates. This is a wheel positioning and clamping system.

The lifting cylinder 21 is mounted on the support frame 20, the output end of the lifting cylinder 21 is connected with the lifting platform 23, the four guide posts 22 are mounted at the bottom of the lifting platform 23, and the steel grade printer 24 is mounted on the lifting platform 23. Under the guiding effect of the guide posts 22, the lifting cylinder 21 controls up-and-down motion of the lifting platform 23 to adjust the vertical position of the steel grade printer 24, thus printing wheels having different rim widths. When the width of the wheel is changed, only the vertical position of the steel grade printer 24 is correspondingly adjusted. The sensor support 18 is mounted on the frame 1 and portal-shaped, the output end of the steel grade printer 24 penetrates through the portal-shaped hollow area, and the visual sensor 19 is located above the wheel and mounted on the sensor support 18. When the wheel rotates, the visual sensor 19 can recognize the position of a valve hole; and when the valve hole is opposite to a steel grade head, the wheel stops rotating, and the steel grade printer 24 is started to print a steel grade on the rim below the valve hole. This is a wheel steel grade printing system.

The two slide ways 2 are respectively mounted on the left side and right side of the frame 1, slide rails 25 are arranged at two ends of the first moving platform 3, and the slide rails 25 are matched with the slide ways 2. The first station driving cylinder 15 is mounted on the frame 1, and the output end of the first station driving cylinder 15 is connected with the first moving platform 3 and drives the first moving platform 3 to move along the slide ways 2. When the output end of the first station driving cylinder 15 is extended, the first moving platform 3 is driven to be butt-jointed with the wheel inlet roller bed 12; after the wheel enters the working roller bed 11, the positioning and clamping system clamps the wheel; and when the output end of the first station driving cylinder 15 is retracted and reset, the first moving platform 3 is driven to reset, and the steel grade printing system prints a steel grade on the rim below the valve hole. This is a first station.

The second station is completely the same as the first station, and is also composed of a wheel positioning and clamping system and a steel grade printing system. Slide rails 25 are arranged at two ends of the second moving platform 17, and the slide rails 25 are matched with the slide ways 2. The second station driving cylinder 16 is mounted on the frame 1, the output end of the second station driving cylinder 16 is connected with the second moving platform 17 and drives the second moving platform 17 to move along the slide ways 2, and the same wheel positioning and clamping system is arranged on the second moving platform 17 as on the first moving platform 3.

The working process of the device is as follows: in an initial state, the first station driving cylinder 15 and the second station driving cylinder 16 are retracted, and the first moving platform 3 and the second moving platform 17 are not butt-jointed with the wheel inlet roller bed 12. Firstly, the first station driving cylinder 15 is started to drive the first moving platform 3 to be butt-jointed with the wheel inlet roller bed 12, and the wheel enters the working roller bed 11 from the wheel inlet roller bed 12; then, the clamping cylinder 8 is started to position and clamp the wheel; next, the first station driving cylinder 15 is retracted to bring the clamped wheel to the first station. At the moment, the second station driving cylinder 16 is started to drive the second moving platform 17 to be butt-jointed with the wheel inlet roller bed 12, and the wheel enters the working roller bed 11 from the wheel inlet roller bed 12; and then the wheel is positioned, clamped and brought to the second station. When platform butt joint and wheel positioning and clamping are performed on the second station and the second moving platform 17 brings the wheel to the second station, operations of wheel rotation, finding of the valve hole, printing of the steel grade, loosening of the wheel and feeding to the first wheel outlet roller bed 13 are completed. After the second moving platform 17 brings the wheel to the second station, the first station driving cylinder 15 is restarted to drive the first moving platform 3 to be butt-jointed with the wheel inlet roller bed 12 again, next wheel is positioned and clamped, and at the same time, operations of wheel rotation, finding of the valve hole, printing of the steel grade, loosening of the wheel and feeding to the second wheel outlet roller bed 14 are completed. Next, the second station driving cylinder 16 is restarted to drive the second moving platform 17 to be butt-jointed with the wheel inlet roller bed 12 again, next wheel is positioned and clamped, and recycling like this.

In the working process of the device, the wheel inlet roller bed continuously feeds wheels, and the first station and the second station alternatively receive the wheels, thereby avoiding long-time waiting of the wheels on the wheel inlet roller bed. Printing steel grade is completed within the wheel positioning and clamping time, so the production period is determined by the time sum of platform butt joint, wheel positioning and clamping and platform reset, and the wheel positioning and clamping process and the steel grade printing process are completed within the same time via the double stations, so that the period is greatly shortened; and the device has the advantages of short period, high efficiency, novel layout, advanced process and strong generality.

The foregoing descriptions of specific exemplary embodiments of the present application have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A double-station printing device for printing a steel grade on rims, comprising a frame, slide ways, a first moving platform, guide rails, a left slide plate, a right slide plate, gear racks, clamping cylinders, servo motors, clamping rollers, working roller beds, a wheel inlet roller bed, a first wheel outlet roller bed, a second wheel outlet roller bed, a first station driving cylinder, a second station driving cylinder, a second moving platform, sensor supports, visual sensors, support frames, lifting cylinders, guide posts, lifting platforms and steel grade printers, characterized in that the two slide ways are respectively mounted on the left side and right side of the frame, slide rails are arranged at two ends of the second moving platform, and the slide rails are matched with the slide ways; the first station driving cylinder is mounted on the frame, and an output end of the first station driving cylinder is connected with the first moving platform and drives the first moving platform to move along the slide ways by the slide rails; when the output end of the first station driving cylinder is extended, the first moving platform is driven to be butt-jointed with the wheel inlet roller bed; and when the output end of the first station driving cylinder is retracted and reset, the first moving platform is driven to reset.

2. The double-station printing device for printing a steel grade on rims of claim 1, wherein the second station is completely the same as the first station, and is also composed of a wheel positioning and clamping system and a steel grade printing system; slide rails are arranged at two ends of the second moving platform, and the slide rails are matched with the slide ways; the second station driving cylinder is mounted on the frame, and an output end of the second station driving cylinder is connected with the second moving platform and drives the second moving platform to move along the slide ways by the slide rails.

3. The double-station printing device for printing a steel grade on rims of claim 1, wherein the wheel inlet roller bed continuously feeds wheels, and the first station and the second station alternately receive the wheels, so that a wheel positioning and clamping process and a steel grade printing process are completed within the same time via the double stations;

the working process of the device is as follows: in an initial state, the first station driving cylinder and the second station driving cylinder are retracted, and the first moving platform and the second moving platform are not butt-jointed with the wheel inlet roller bed; first, the first station driving cylinder is started to drive the first moving platform to be butt-jointed with the wheel inlet roller bed, and the wheel enters the working roller bed from the wheel inlet roller bed; then, the clamping cylinder is started to position and clamp the wheel; next, the first station driving cylinder is retracted to bring the clamped wheel to the first station; at the moment, the second station driving cylinder is started to drive the second moving platform to be butt-jointed with the wheel inlet roller bed, and the wheel enters the working roller bed from the wheel inlet roller bed; and then the wheel is positioned, clamped and brought to the second station; when platform butt joint and wheel positioning and clamping are performed on the second station and the second moving platform brings the wheel to the second station, operations of wheel rotation, finding of the valve hole, printing of the steel grade, loosening of the wheel and feeding to the first wheel outlet roller bed are completed; after the second moving platform brings the wheel to the second station, the first station driving cylinder is restarted to drive the first moving platform to be butt-jointed with the wheel inlet roller bed again, next wheel is positioned and clamped, and at the same time, operations of wheel rotation, finding of the valve hole, printing of the steel grade, loosening of the wheel and feeding to the second wheel outlet roller bed are completed; next, the second station driving cylinder is restarted to drive the second moving platform to be butt-jointed with the wheel inlet roller bed again, next wheel is positioned and clamped, and recycling like this.

* * * * *